United States Patent [19]

Gill et al.

[11] 4,054,717

[45] Oct. 18, 1977

[54] MINERAL PAPER COATING COMPOSITIONS CONTAINING LATEX AND AMPHOTERIC POLYMER

[75] Inventors: Robert A. Gill, Abington; Joseph J. Latimer, Perkiomenville; Arthur D. Jordan, Jr., Philadelphia, all of Pa.

[73] Assignee: Rohm and Haas Company, Philadelphia, Pa.

[21] Appl. No.: 633,301

[22] Filed: Nov. 19, 1975

[51] Int. Cl.[2] ..... B32B 9/06; C08F 45/06; C08F 45/18

[52] U.S. Cl. ..... 428/452; 260/8; 260/17.4 ST; 260/29.6 WB; 428/454; 428/476; 428/477; 428/478; 428/512; 428/513; 428/514; 428/533; 428/537; 260/29.6 HN

[58] Field of Search ..... 428/452, 454, 476, 477, 428/478, 533, 537, 512, 513, 514; 260/29.6 WB, 8, 17.4 ST, 29.6 HN

[56] References Cited

U.S. PATENT DOCUMENTS

| | | | |
|---|---|---|---|
| 2,790,735 | 4/1957 | McLaughlin | 428/452 |
| 2,790,736 | 4/1957 | McLaughlin | 428/452 |
| 2,874,066 | 2/1959 | McLaughlin | 428/452 |
| 3,048,501 | 8/1962 | Miller | 428/452 |
| 3,177,172 | 4/1965 | Adams | 260/29.6 WB |
| 3,404,114 | 10/1968 | Snyder | 260/29.6 WB |
| 3,583,881 | 6/1971 | Kennedy | 428/520 |
| 3,671,472 | 6/1972 | McNamee | 428/452 |
| 3,799,902 | 3/1974 | Anderson | 260/29.6 WB |
| 3,849,183 | 11/1974 | Chick | 428/452 |

*Primary Examiner*—Ellis Robinson
*Attorney, Agent, or Firm*—Harold L. Greenwald; Carl A. Castellan

[57] ABSTRACT

Mineral coating compositions for coating papers, the binder of which comprises a negatively-charged latex or an aqueous dispersion of an emulsion polymer, with or without an amylaceous binder, as the major portion thereof, and a relatively small amount of a water-soluble addition polymer having polymerized therein from 20% to 100%, preferably at least 40%, by weight of a monoethylenically unsaturated monomer having a primary, secondary, or tertiary amine group, such as an aminoalkyl acrylate, methacrylate, vinyl ether or vinyl sulfide, an N-aminoalkyl(meth)acrylamide, an N-acryloxyalkyl-oxazolidine or an N-acryloxyalkyl-tetrahydro-1,3-oxazine.

10 Claims, No Drawings

MINERAL PAPER COATING COMPOSITIONS CONTAINING LATEX AND AMPHOTERIC POLYMER

BACKGROUND OF THE INVENTION

In U.S. Pat. No. 3,671,472, there have been disclosed mineral coating compositions in which an amylaceous material, such as starch, has been upgraded in respect to the water-resistance of coatings obtainable on paper by the use of water-insoluble, amine-containing emulsion polymers with amylaceous binders, using the polymer in an amount of 20% to 70% by weight of the total weight of such polymer and the binder.

DESCRIPTION OF THE INVENTION

In accordance with the present invention, certain water-soluble amine-containing polymers have been found to improve the water-resistance of paper coatings in which the mineral pigment is mixed with an inexpensive negatively-charged latex polymer, i.e., a water-insoluble polymer dispersed in a latex such as is formed by emulsion polymerization, which serves as the primary binder whether or not such polymer is used in conjunction with other binder materials, such as an amylaceous material, e.g., starch, or not.

This invention concerns a coating composition adapted to coat papers consisting essentially of an aqueous dispersion of (1) a finely divided pigmentary material comprising a predominant proportion of clay therein and (2) a binder, in an amount of 5 weight percent to 50 weight percent based on pigment weight, comprising (a) a negatively-charged latex polymer free of amine groups with or without another binder material and (b) a water-soluble polymer of 20% to 100% by weight of units containing a primary, secondary, or tertiary amine group, the amount of (b) being from 0.1% to 10% by weight of the pigment, but not over 18% by weight of binder component (a).

The invention is concerned with the use, as the primary binder, or as the predominant part thereof, of a negatively-charged latex of a water-insoluble polymer, particularly those of vinyl acetate with or without other monomers, such as vinyl chloride, vinylidene chloride, etc., styrene-butadiene polymers (SBR), acrylonitrilebutadiene-styrene (ABS) copolymers, and (meth)acrylic ester polymers and copolymers. In each type of polymer, the negative charge is obtained as the result of including in the polymers small amounts of acid groups, which may be in salt form, (as of an alkali metal of ammonium), such as of maleic acid, vinyl sulfonic acid, crotonic acid, acrylic acid, methacrylic acid, itaconic acid, and the like. Examples of such negatively-charged latex polymers include those disclosed in U.S. Pat. Nos. 2,790,735; 2,790,736; and 2,874,066. The latices with which the present invention is concerned include those in which the acid groups are intentionally introduced at the time of polymerization as well as those in which, in the normal course of events, a small amount of units in the polymer hydrolyze to form acid groups during synthesis, storage, or use.

More particularly, in accordance with the present invention, it has been found that mineral coating compositions for coating paper using negatively-charged latices of polymers containing no amine groups as a binder for the pigmentary component can be improved in their water-resistance by the inclusion of a relatively small proportion of a water-soluble polymer containing from 20% to 100%, and preferably at least 40%, by weight of an amine-containing monomer including the following categories:

1. Aminoalkyl vinyl ethers of sulfides wherein the alkyl groups may be straight-chain or branched-chain type and have from two to 3 carbon atoms and wherein the nitrogen atom may be a primary, secondary, or tertiary nitrogen atom (U.S. Pat. No. 2,879,178). In the latter instance, one of the remaining hydrogen atoms may be substituted by alkyl, hydroxyalkyl, or alkoxyalkyl groups, the alkyl components of which may have one to four carbon atoms, preferably one carbon atom only. Specific examples include:

β-aminoethyl vinyl ether
β-aminoethyl vinyl sulfide
N-monomethyl-β-aminoethyl vinyl ether or sulfide
N-monoethyl-β-aminoethyl vinyl ether or sulfide
N-monobutyl-β-aminoethyl vinyl ether or sulfide
N-monomethyl-3-aminopropyl vinyl ether or sulfide 2. Acrylamide or acrylic esters, such as those of the formula II

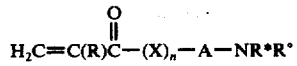

(II)

wherein R is H or $CH_3$,
$n$ if 0 or 1,
X is —O— or —N(H),
A, when $n$ is zero, is $—O(CH_2)_x—$ wherein $x$ is 2 to 3, or -(O-alkylene)$_y$ wherein -(O-alkylene)$_y$ is a poly(oxyalkylene) group, having a molecular weight in the range from 88 to 348, in which the individual alkylene radicals are the same or different and are either ethylene or propylene, and
A, when $n$ is 1, is an alkylene group having two to 4 carbon atoms, and
R* is H, methyl, or ethyl,
R° is H, phenyl, benzyl, methylbenzyl, cyclohexyl, or ($C_1$–$C_6$) alkyl.

Examples of compounds of formula II include:

dimethylaminoethylacrylate or methacrylate
β-aminoethyl acrylate or methacrylate
N-β-aminoethyl acrylamide or methacrylamide
N-(monomethylaminoethyl)-acrylamide or methacrylamide
N-(mono-n-butyl)-4-aminobutyl acrylate or methacrylate methacryloxyethoxyethylamine
acryloxypropoxypropoxypropylamine 3. N-acryloxyalkyl-oxazolidines and N-acryloxyalkyltetrahydro-1,3-oxazines and the corresponding compounds in which the "alkyl" linkage is replaced by alkoxyalkyl and poly(alkoxy-alkyl), all of which are embraced by Formula III:

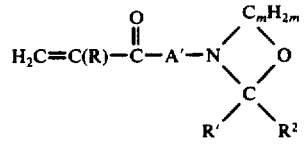

(III)

wherein R is H or $CH_3$,
$m$ is an integer having a value of 2 to 3,

R', when not directly joined to $R^2$, is selected from the group consisting of hydrogen, phenyl, benzyl, and $(C_1-C_{12})$ alkyl groups, $R^2$, when not directly joined to R', is selected from the group consisting of hydrogen and $(C_1-C_4)$ alkyl groups, R' and $R^2$, when directly joined together, form a 5- to 6-carbon ring with the attached carbon atom of the ring in the formula, i.e., R' and $R^2$, when joined together, are selected from the group consisting of pentamethylene and tetramethylene, and A' is $-O(C_mH_{2m})-$ or $(O\text{-alkylene})_n$ in which $(O\text{-alkylene})_n$ is a poly(oxyalkylene) group, having a molecular weight in the range from 88 to 348, in which the individual alkylene radicals are the same or different and are either ethylene or propylene.

The compounds of Formula III can hydrolyze under various conditions to secondary amines. The hydrolysis produces products having the Formula IV:

$$H_2C{=}C(R){-}\overset{\overset{\displaystyle O}{\|}}{C}{-}A'N(H){-}(C_mH_{2m}){-}OH \qquad \text{(IV)}$$

The compounds of Formula III are disclosed in U.S. Pat. No. 3,037,006 and Ser. No. 532,015, filed Jan. 6, 1966, now U.S. Pat. No. 3,502,627 in the hands of a common assignee, and their corresponding foreign applications and patents and any of the monomeric compounds disclosed therein may be used in making the copolymers to be used in the mineral coating compositions of the present invention.

Examples of compounds of Formula III include:

Oxazolidinylethyl methacrylate
Oxazolidinylethyl acrylate
3-(gamma-methacryloxypropyl)-tetrahydro-1,3-oxazine
3-(β-methacryloxyethyl)-2,2-pentamethyleneoxazolidine
3-(β-methacryloxyethyl)-2-methyl-2-propyloxazolidine
N-2-(2-acryloxyethoxy)ethyl-oxazolidine
N-2-(2-methacryloxyethoxy)ethyl-oxazolidine
N-2-(2-methacryloxyethoxy)ethyl-5-methyl-oxazolidine
N-2-(2-acryloxyethoxy)ethyl-5-methyl-oxazolidine
3-[2-(2-methacryloxyethoxy)ethyl)]-2,2-pentamethylene-oxazolidine
3-[2-(2-methacryloxyethoxy)ethyl)]-2,2-dimethyloxazolidine
3-[2-(methacryloxyethoxy)ethyl)]-2-phenyl-oxazolidine.

4. Acryloxy-ketimines and -aldimines, such as those of formulas V and VI following:

$$H_2C = C(R) - COOA''N = Q \qquad \text{(V)}$$

$$H_2C = C(R) - CO - (D)_{n''-1}-(B)_{n'-1}-(A^\circ)_{n^\circ-1}-N = Q \qquad \text{(VI)}$$

wherein

R is H or $CH_3$,

Q is selected from the group consisting of

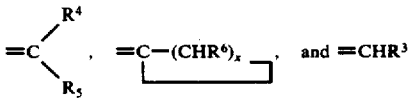

$R^6$ is H or it may be methyl in one $CHR^6$ unit, $R^4$ is selected from the group consisting of $(C_1-C_{12})$-alkyl and cyclohexyl groups, $R^5$ is selected from the group consisting of $(C_1-C_{12})$-alkyl and cyclohexyl groups, $R^3$ is selected from the group consisting of phenyl, halophenyl, $(C_1-C_{12})$alkyl, cyclohexyl, and $(C_{1-C4})$ alkoxyphenyl groups, A'' is a $(C_2-C_{12})$ alkylene group, A°, B and D are the same or different oxyalkylene groups having the formula $-OCH(R^7)-CH(R^7)-$ wherein $R^7$ is H, $CH_3$, or $C_2H_5$, $x$ is an integer having a value of 4 to 5, $n^\circ$ is an integer having a value of 1 to 200, $n'$ is an integer having a value of 1 to 200, and $n''$ is an integer having a value of 1 to 200, the sum of $n^\circ-1$, $n'-1$ and $n''-1$ having a value of 2 to 200.

Illustrative compounds of formulas V and VI are:

2-[4-(2,6-dimethylheptylidene)-amino]-ethyl methacrylate
3-(2-(4-methylpentylidine)-amino)-propyl methacrylate
β-(benzylideneamino)-ethyl methacrylate
3-(2-(4-methylpentylidene)-amino)-ethyl methacrylate
2-[4-(2,6-dimethylheptylidene)-amino]-ethyl acrylate
12-(cyclopentylidene-amino)-dodecyl methacrylate
N-(1,3-dimethylbutylidene)-2-(2-methacryloxyethoxy)-ethylamine
N-(benzylidene)-methacryloxyethoxyethylamine
N-(1,3-dimethylbutylidene)-2-(2-acryloxyethoxy)ethylamine
N-(benzylidene)-2-(2-acryloxyethoxy)ethylamine The compounds of formulas V and VI hydrolyze in acid, neutral, or alkaline aqueous media to produce salts of the corresponding primary amines in which the group $-N = Q$ of the formulas becomes $-NH_2$. The compounds of formulas V and VI are disclosed in U.S. Pat. No. 3,037,969 and copending application Ser. No. 485,591, filed Sept. 7, 1965 (now U.S. Pat. No. 3,497,485) and any of the monomeric compounds therein disclosed may be used in the making of the copolymers to be used in the mineral-coating compositions of the present invention.

By water-solubility is meant that the polymer is soluble either in free-base, neutral, or salt form. In other words, the solubility preferably exists at all pH's, especially in the range of about 4 to 10 and at least in the pH range of 7.5 to 10.

In general, the amine-containing polymers of 20 to 100% by weight of a monomer of categories 1., 2., 3., and 4. above that are water-soluble may be obtained by solution polymerization in aqueous media, either neutral, alkaline, or acidic, depending upon the particular polymer sought. Generally, the polymerization is carried out in an aqueous medium containing a small amount of an acid which is either organic or inorganic, such as acetic acid of hydrochloric acid. The water-soluble amine-containing polymers include copolymers with up to 80% by weight one or more monoethylenically unsaturated monomers having appreciable water-solubility, such as methyl acrylte, acrylamide, methacrylamide, monomethyl itaconate, acrylic acid, methacrylic acid, and itaconic acid. Small amounts of relatively insoluble comonomers may also be used provided the amount thereof incorporated in the polymer does not interfere detrimentally with the solubility in water required of the amine-containing polymer. Such monomers include, as examples, acrylic acid esters with ($C_2$ to $C_{18}$) alcohols and methacrylic acid esters with alcohols having one to 18 carbon atoms, especially ($C_1$-$C_4$) alkanols; styrene, vinyltoluene, vinyl acetate, vinyl chloride, vinylidene chloride, substituted styrenes, butadiene, substituted butadienes, and ethylene. The particular comonomer or comonomers used in making a given water-soluble amine-containing polymer depends upon the proportion of amine-containing monomer used in making the copolymer. Preferably, a water-soluble comonomer is exclusively used.

The molecular weight of the water-soluble polymers may fall within a wide range but in general they are of relatively low molecular weight. For example, in the case of homopolymers and the copolymers having 40% by weight or more of the amine-containing monomer therein, the polymers have a molecular weight from about 5,000 number average to about 100,000 viscosity average. Those having less than 40% of the amine-containing monomer have higher molecular weights, such as up to 900,000 or more viscosity average. The polymers in the higher molecular weight range may be produced by emulsion polymerization when the amine-containing monomer is so hydrophobic or its level is so low as to require dispersion in the system with an emulsifier. In this case, the control of the molecular weight may be facilitated by the use of a chain transfer agent.

The pigment that may be employed in the mineral coatings include a variety of clays, such as bentonite and montmorillite, and especially of the kaoline type. Calcium carbonate, blanc fixe, talc, titanium dioxide, colored lakes and toners, carbon black, graphite, aluminum powder or flakes, and various colored pigments may be used but a clay type pigment is necessary to obtain the most efficient amine-pigment inter-action and water-resistance. The other pigments mentioned may be used but are preferably used in admixture with a clay-type pigment to assure that good water-resistance is obtained in the coated articles. The term "mineral" in the claims is intended to cover all such types of pigmentary matter whether of strictly mineral character or partly of organic material.

The pigment or pigments are preferably mixed and dispersed in a small amount of water before mixing with the copolymer dispersion. When clay is used as a part of the pigment, and in preferred embodiments, it forms a predominant proportion of the pigment. The dispersion is preferably adjusted to a pH of 8.5 to 9.5 to obtain the optimum dispersion of the clay. The amount of binder including the negatively-charged latex as well as the water-soluble amine-containing polymer used in the mineral coating compositions of the present invention may range from about 5 to 50% by weight of the pigment and is preferably about 12 to 20% by weight thereof.

The amount of the water-soluble amino-polymer may range from 0.1 to 10% by weight of the pigment used in the composition, but does not exceed 18% by weight, based on the total weight of binder, other than the water-soluble amino-containing polymer. Preferably, it is used in the range of 3 to 10% by weight, based on the total weight of the binder other than the water-soluble amino-containing polymer. If desired, the negatively-charged latex may be supplemented with or mixed with (up to about an equal weight thereof) other binders such as amylaceous materials, (e.g., starch or the various materials mentioned in column 4, lines 28-35 of U.S. Pat. No. 3,671,742) proteinaceous materials, such as glue, gelatin, albumin, casein, and alpha protein, aminoplasts, such as urea/formaldehyde or melamine/formaldehye resin-forming condensates, water-soluble or -dispersible linear polyester resins or cellulose ethers or esters, e.g., hydroxyethyl cellulose, carboxymethyl cellulose, and so on. This additional material is, of course, unnecessary to provide the properties desired although it may provide useful peripheral properties such as viscosity control or cost.

The pigment is converted into a paste, mixed with the negatively-charged latex binder and the water-soluble polymer is mixed therewith. The water-soluble polymer may be mixed with the negatively-charged latex at a pH of 8 to 9.5 and then the pigment is mixed thereinto. Generally, the pigment comprises a major amount of clay and after suitably mixing the pigment, the latex and the water-soluble polymer in the pH range above, preferably around a pH of 9, the resulting coating composition is applied to the paper or paperboard. It may be applied at any concentration, but ordinarily it is applied at a total solids concentration of at least 15 percent and preferably 35 percent to 70 percent by any suitable equipment, such as immersion roll and doctor system, trailing blade, air knife, size press, gravure roller system, brush coater, or spray coater. It may be applied to the paper after drying, and/or conditioning. Alternatively, it may be applied during the first drying operation on the paper where it has under gone only partial drying. For example, the coating system may be mounted at an intermediate point in the drier on the paper-making machine, such as at a point where the paper has been reduced to approximately 50 percent moisture content.

After the coating operation, the coated sheet is dried and may then be calendered, and subsequently printed. The drying may be the usual type provided in which air at about 230° to 260° F. (110° to 130° C.) is directed against the paper for 30 to 45 seconds. The paper and coating may reach a temperature of about 180° F. (ca. 85° C.) during the drying operation. Printing may be effected by the conventional inks of precipitation type or heat setting type including those based on drying oils. The coated products of the present invention are receptive to single color inks and multi-color inks of graded viscosity and are able to withstand the pull of such inks. They may be overcoated, after printing, with wax, lacquer, or other compositions.

To assist those skilled in the art to practice the present invention, the following modes of operation are suggested by way of illustration, parts and percentages being by weight and the temperature in °C. unless otherwise specifically noted.

In the wet rub test used in the examples, a 2-inch × 3-inch sample is soaked in 25 ml of deionized water for one minute in a shallow dish about 3.5 inches in diameter. While under water, the sample is rubbed 40 strokes in one direction. The sample is removed and the turbidity of the suspension is measured at 600 nm on a spectrophotometer. Deionized water is set at 100% transmittance and a closed shutter is 0%. At least three samples should be run. Values of 90 to 100 percent transmittance indicate no coating failure while decreasing readings are obtained as greater coating failure occurs.

EXAMPLE A

A 5-liter glass kettle equipped with stirrer, nitrogen inlet, thermometer, heating mantle, and feed pumps is charged with 1500 g. of deionized water. Nitrogen is fed through the charge, the latter is stirred and a nitrogen blanket is maintained on it. Then 7.0 g. of 0.15% aqueous $FeSO_4.7H_2O$ and 2.0 g. 1% aqueous Versene are added, the mixture is heated to 60° C. and simultaneous addition over a two-hour period are effected with:

Feed No. 1

500.0 g. 2-(3-oxazolidinyl)ethyl methacrylate (OXEMA)
500.0 g. deionized water
5.0 g. 70% aqueous tertiary-butyl hydroperoxide (TBHP)

Feed No. 2

5.0 g. sodium formaldehyde sulfoxylate $.2H_2O$ (SFS) diluted with water to 14.4 ml.

After completion of the feeds, the mixture is kept at 60° C. for 30 minutes, 0.4 g. 70% TBHP is added, 15 minutes later 0.15 g. SFS in 5.0 g. deionized water is added, being followed immediately with an addition of 0.25 g. of 70% TBHP. Fifteen minutes later, the mixture is cooled to room temperature yielding a clear greenish-amber solution of total solids 17.9%, pH 8.3 and Brookfield viscosity (No. 1 spindle, 60 rpm) of 15 cps.

EXAMPLE 1 a. One hundred parts of fine coating clay (kaolin) and 0.2 part of sodium hexametaphosphate are mixed in 43 parts of water and 0.2 percent (on the weight of clay) of ammonium hydroxide is added to adjust the pH to 9.

b. Corn starch (ethoxylated) is solubilized at 20% solids in water by heating at 190° F. for 30 minutes. Nine parts of the starch (solids basis based on clay) are mixed into 100 parts (solids basis) of the clay suspension obtained in part a). Then there are added 9 parts (solids basis) of a commercial latex dispersion of styrene/-butadiene/acrylic acid copolymer (50% solids) in which the several monomers are present in the ratio 40/57/3. To this mixture, adjusted to pH = 9.0 with ammonia, is added one part (solids basis based on clay) of an aqueous polymer obtained by the solution polymerization of a mixture of 50 parts of methyl acrylate and 50 parts of oxazolidinylethyl methacrylate in about 900 parts of water in the presence of about 11 parts of t-octyl-phenoxy(poly)ethoxyethanol containing about 40 oxyethylene units by a gradual addition redox polymerization technique with an acetic acid co-feed to insure solubility throughout the reaction. The aqueous amino-polymer is adjusted to pH = 9 with ammonia before addition to the starch-clay-SB latex mixture. The resulting mixture is adjusted to 50% solids.

c. A dry bond paper is then coated with the composition obtained in part (b) by means of a No. 10 wire wound rod. About 8 pounds of the coating composition (dry weight) per 3000 ft.$^2$ of the paper is thus applied to one surface. The paper is dried at 180° F. for one minute, conditioned overnight at 73° F. and 50% R.H., and calendered three nips at 700 pounds/lineal inch and 120° F.

d. An analogous composition is prepared in the same fashion as described in part (b) hereof except that the water-soluble amino copolymer is omitted from the formulation. This composition is applied to paper in the same way as described in part (c) hereinabove.

e. Twenty-four hours after the coating, the papers are subjected to the wet rub test described hereinbefore. The % transmittance of the water suspension is measured in a spectrophotometer. The results are as tabulated:

| POLYMERS IN BINDER | % TRANSMITTANCE |
|---|---|
| Those in part c) | 81 |
| Those in part d) | 3 |

EXAMPLE 2

Example 1 (a), (b), and (c) is repeated except that the water-soluble amino-polymer is replaced by 1 part (solids basis based on clay) of an aqueous polymer obtained by the solution polymerization of a mixture of 50 parts of methyl acrylate and 50 parts of oxazolidinylethyl methacrylate in about 1050 parts of water in the presence of about 5 parts of t-octyl-phenoxy(poly)ethoxyethanol containing about 40 oxyethylene units by a gradual addition redox polymerization technique with an acetic acid co-feed to insure solubility throughout the reaction. The aqueous amino-polymer is adjusted to pH = 9 with ammonia before addition to the starch-clay-SB latex mixture.

The wet rub resistance of the coating thus obtained is tested (as in Example 1 (e)) 24 hours after coating and another test is made of paper prepared as in Example 1 (d) 24 hours after coating. The results are as follows:

| POLYMERS IN BINDER | % TRANSMITTANCE |
|---|---|
| Amino-polymer | 27 |
| No amino-polymer | 3 |

EXAMPLE 3

The procedure of Example 1 is followed except that the SB copolymer is replaced by the same proportion of a copolymer of 77% ethyl acrylate, 18% methyl methacrylate and 5% of methacrylic acid having a Ti of 6° C. The coated paper is dried and shows good wet rub resistance.

EXAMPLE 4

The procedure of Example 1 (b) and (c) is followed except the starch is omitted and 18 parts (solids basis) of a latex (47% solids) of a copolymer of 64 parts of ethyl acrylate/31 parts of methyl methacrylate/3 parts of methacrylic acid is used in place of the styrene/-butadiene/acrylic acid latex polymer. Testing as in Example 1 (d) gives comparable resistance.

EXAMPLE 5

The procedure of Example 1 (a), (b), and (c) is repeated except that the amino copolymer is replaced with the same amount of the homopolymer obtained in Example A. Comparable wet-rub resistance is obtained.

EXAMPLE 6

Wet-rub resistant paper coatins may be obtained when Example 1 (a), (b), and (c) is repeated except that the water-soluble copolymer is replaced with a water-soluble polymer as follows:

a. homopolymer of dimethylaminoethyl acrylate
b. copolymer of N-(benzylidene)-methacryloxyethoxyethylamine/methyl acrylate (60/40 weight ratio)
c. copolymer of acryloxyethoxyethylamine trihydrogen phosphate/acrylamide (ratio 20/80)

d. copolymer of aminoethyl acrylate/methyl acrylate/monomethyl itaconate (ratio 30/65/5)
e. copolymer of aminoethyl vinyl ether/methyl acrylate/methacrylic acid (ratio 40/57/3)
f. copolymer of monomethylaminoethyl methacrylate/methyl acrylate/vinyl acetate (ratio 60/38/2).

The molecular weights of these polymers are in the range of 5000 number average up to about 300,000 viscosity average and are useful even up to about 900,000 viscosity average molecular weight.

Whereas the earlier U.S. Pat. No. 3,671,472 discloses the use of high molecular weight emulsion polymers for the improvement of the water-resistance of clay-containing paper coating compositions using starch as the primary binder, it has been found that the use, as disclosed in that patent, of the amine-containing emulsion polymer is effective in producing water-resistant coatings only when used in large amounts relative to the binder. In accordance with the present invention, it has been found that a water-soluble polymer containing amine-containing units in spite of its water-solubility, serves to form a combination with the negatively-charged binder and the negatively charged clay that is similar to a combination commonly referred to as a liposalt. In spite of the fact, however, that this combining action is effected by a water-soluble link, the components that are connected together by this link through ionic junctures apparently have hydrophobic termini that protect the ionic linkages from dissociating on exposure to water. This cooperation is unexpected since it has been found that the preparation of a derivative of starch containing oxazolidine groups is not effective in the binding action with clay to render analogous mineral coating compositions water-resistant.

It is further surprising that a much lower quantity of the water-soluble polymer containing amine-containing units is effective to render a coating obtained from a clay/negatively-charged emulsion polymer, with or without starch to improve the water-resistance of such coating compositions.

However, it is not intended that the invention herein be limited to the theory of operation discussed hereinabove.

What is claimed is:

1. In a coating composition adapted to coat papers consisting essentially of an aqueous dispersion of (1) a finely divided pigmentary material comprising a major amount of clay therein and (2) a binder, in an amount of 5 weight percent to 50 weight percent based on pigment weight, comprising (a) a negatively-charged latex polymer free of amine groups with or without another binder material the improvement wherein the binder additionally comprises (b) a water-soluble polymer of 20% to 100% by weight of units containing a monoethylenically unsaturated monomer having a primary, secondary, or tertiary amine group, the amount of (b) being from 0.1% to 10% by weight of the pigment, but not over 18% by weight of binder component (a), the molecular weight of (b) being from about 5000 number average to about 900,000 viscosity average.

2. A composition according to claim 1 in which the component (a) of the binder also comprises an amylaceous or proteinaceous material.

3. A composition according to claim 1 in which the negatively-charged latex polymer is a styrene/-butadiene/acid copolymer.

4. A composition according to claim 1 in which the negatively charged latex polymer is an acrylic esteracid copolymer.

5. A composition according to claim 1 in which the water-soluble polymer is a polymer of a monomer of Formula II as defined in the specification.

6. A composition according to claim 1 in which the water-soluble polymer is a polymer of a monomer of Formula III as defined in the specification.

7. A composition according to claim 1 in which the water-soluble polymer is a polymer of at least 20% by weight of oxazolidinylethyl methacrylate.

8. A composition according to claim 7 in which the water-soluble polymer is a copolymer of at least 40% by weight of oxazolidinylethyl methacrylate with methyl acrylate.

9. A composition according to claim 8 in which the binder component (a) comprises an amylaceous material.

10. A mineral-coated paper product in which a paper sheet carries on a surface thereof a dried deposit of a coating composition as defined in claim 1.

* * * * *